United States Patent [19]

Grody et al.

[11] 4,099,711

[45] Jul. 11, 1978

[54] DIVIDER FOR STACKER MECHANISM

[75] Inventors: Donald R. Grody, Pittsfield, Mass.; Donald C. Fitzpatrick, Chatham, N.Y.

[73] Assignee: Lenox Machine Company, Lenox, Mass.

[21] Appl. No.: 758,764

[22] Filed: Jan. 12, 1977

[51] Int. Cl.[2] ..... B65H 31/20; B65H 31/24

[52] U.S. Cl. ..... 271/64; 53/260; 83/89; 83/102.1; 108/61; 211/495; 214/6 M; 214/6 S; 221/101; 271/213; 271/223

[58] Field of Search ..... 271/223, 224, 220, 213, 271/64, 207, 217, 221, 222, 63, 210; 93/93 DP, 93 R, 93 D; 214/6 M, 6 S; 53/260, 263; 211/495, 184; 83/91, 93, 89, 102, 102.1, 105; 108/60, 61; 221/307, 308, 310, 101

[56] References Cited

U.S. PATENT DOCUMENTS

| | | | |
|---|---|---|---|
| 3,021,656 | 2/1962 | DeVries | 53/260 X |
| 3,430,950 | 3/1969 | Marsh et al. | 271/64 |
| 3,463,485 | 8/1969 | Atwood | 271/221 |
| 3,504,956 | 4/1970 | Schottland | 108/61 X |
| 3,662,901 | 5/1972 | Brintley | 271/223 X |

*Primary Examiner*—Bruce H. Stoner, Jr.
*Attorney, Agent, or Firm*—Hill, Gross, Simpson, Van Santen, Steadman, Chiara & Simpson

[57] ABSTRACT

A divider assembly for dividing adjacent stacks of sheets during stacking in a stacker mechanism including a tray, mechanism for moving the tray from a sheet receiving position to a sheet discharging position, and a pusher for discharging sheets from the tray in its sheet discharging position. The divider itself is positionable on the tray to separte sheets into separate adjacent stacks, and includes a relatively thin central core, with a plurality of flexible feet secured to the core and having free ends extending below the lower edge of the core. The divider also includes a hinge interconnecting the pair of flexible feet so that the feet with the hinge may be collapsed inwardly when the divider is withdrawn from between the adjacent stacks, thereby permitting easy withdrawal of the divider from between the stacks.

8 Claims, 6 Drawing Figures

DIVIDER FOR STACKER MECHANISM

BACKGROUND OF THE INVENTION

1. Field of the Invention

The present invention is in the field of stacker mechanisms and more particularly is directed to a divider for such stacker mechanisms, the divider having flexible feet extending outwardly from the divider proper to guard against misalignment of the bottom sheets of the stack, and to permit easy withdrawal from between adjacent stacks.

2. Description of the Prior Art

In a commonly used sheeting assembly, a wide continuous paper web is passed between a series of shear cut slitters which divide the web longitudinally and then through a series of knives which cut the webs transversely. The paper sheets are then fed to one or another of a pair of trays, depending upon the positioning of an operating gate. As one tray is filling, the second is discharging. Each tray is provided with a vibratory pusher or the like which discharges the stack of sheets from the tray onto a discharge conveyor.

Such sheet stackers previously used vertical dividers which were positioned to engage the sheets from below. The whole assembly, including the accumulated sheets was vibrated to produce a neat stack. As the sheet size and/or the stack height was increased, however, the vibration became ineffective. Attempts were then made to mount the dividers from an overhead position and thereby allow vibration of the divider. In such instances, however, the first sheets of the stack became lodged beneath the divider and were therefore out of position.

SUMMARY OF THE INVENTION

The present invention provides a novel collapsing bottom attachment in the divider to contain the first sheets, but still allows the stacking divider to be separated vertically. The divider assembly includes no moving parts. The divider is provided with a pair of feet which are adhesively secured to opposite sides of the divider and have feet portions which flex outwardly in contact with the tray to confine the initially laid sheets and prevent them from moving inwardly. The feet portions extend beyond the end of the divider core and are interconnected by means of a flexible hinge which is preferably adhesively secured to both feet. The feet and the hinge portion are completely collapsible so that the effective thickness of the divider is not significantly increased, so that the divider can be readily withdrawn from adjacent stacks. Furthermore, when changing sheet size, only adjustment of the overhead divider is necessary eliminating the need to move a corresponding bottom divider receptacle which was previously used to trap the first sheets. This improvement requires much less adjustment time.

In a preferred form of the present invention, the divider comprises a relatively thin central rigid core, with a pair of flexible strips secured to opposite faces of the core. These strips are preferably composed of a thin synthetic resin. The strips have free end portions which extend therebeyond and form the foot portions for the divider. A flexible hinge means consisting of a strip of similar synthetic resin is adhesively secured to the free end portions of the strips to provide a hinge having the required resilience to open each time it is pressed against the bottom of the tray. The combination of the strips with the hinge were found to give a substantial service life and provides a flexure with the proper amount of strength to open, yet collapses easily enough to permit withdrawal from between the stacks.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
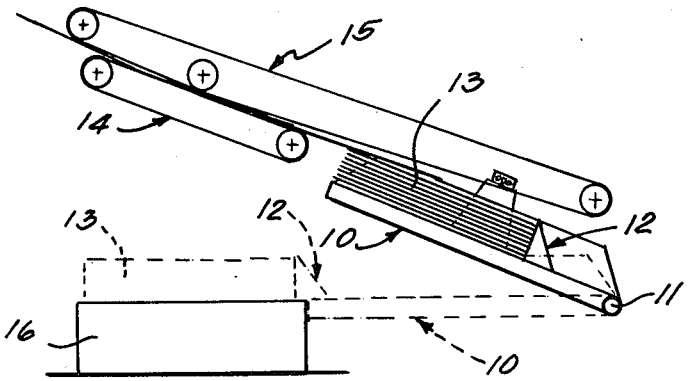
FIG. 1 is a partial schematic view of a sheeting assembly of the type which can be used for the purposes of the present invention.

The improved divider mechanism of the present invention can be used with a conventional type of sheeter mechanism, a portion of which is shown in FIG. 1. In that figure, reference numeral 10 has been applied to a pivotable tray which is pivoted on a shaft 11. The tray carries a pusher mechanism 12 which serves as a stop for a plurality of sheets 13 being delivered thereto by means of a pair of conveyors 14 and 15. Once the loading has been accomplished, the tray 10 is pivoted to the dotted line position shown in FIG. 1, whereupon the pusher 12 delivers a stack of sheets 13 to a discharge conveyor 16.

Figure 2:
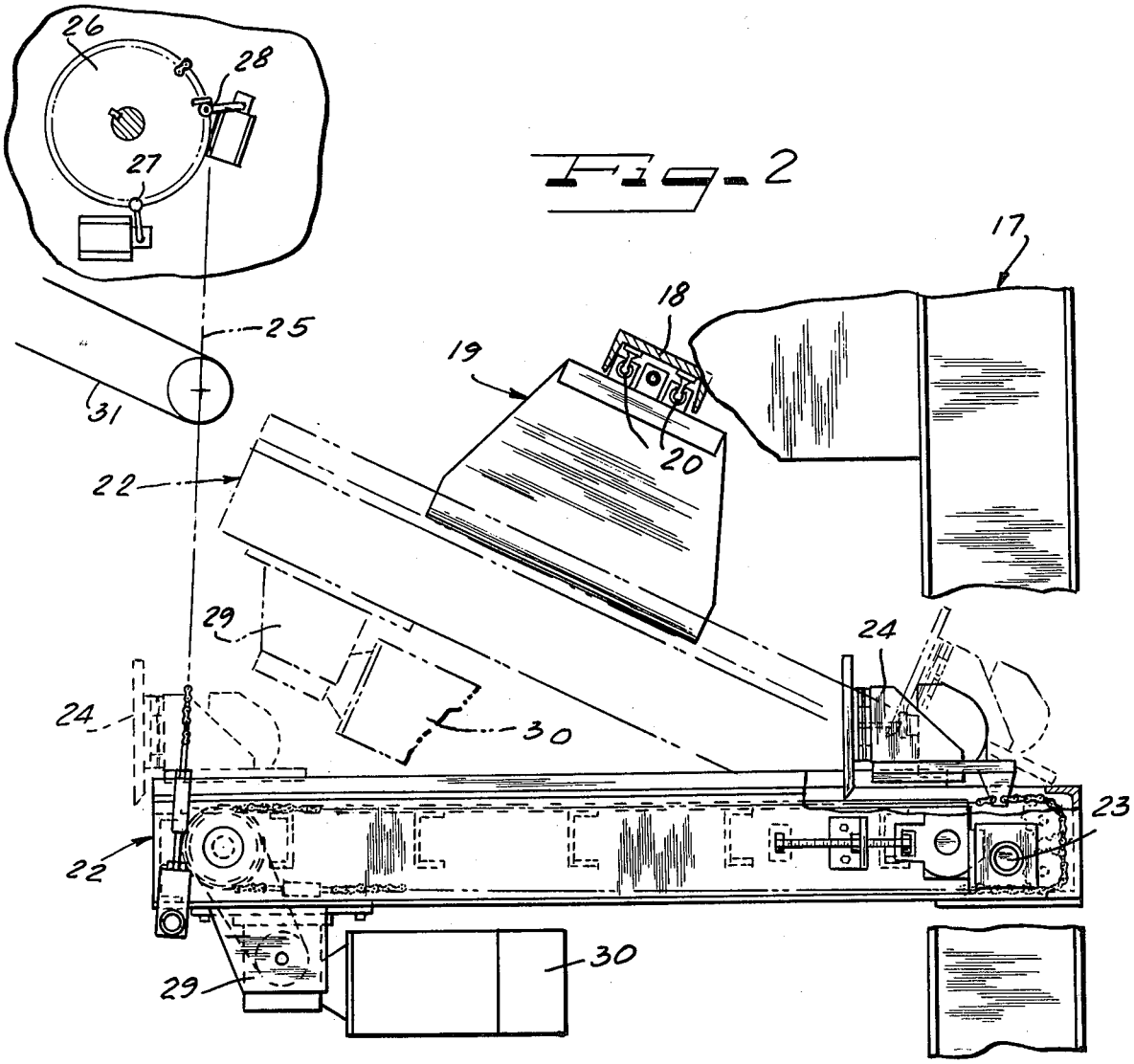
FIG. 2 is a fragmentary view in elevation of the mechanism for moving the trays into loading and discharge positions.
Figure 3:
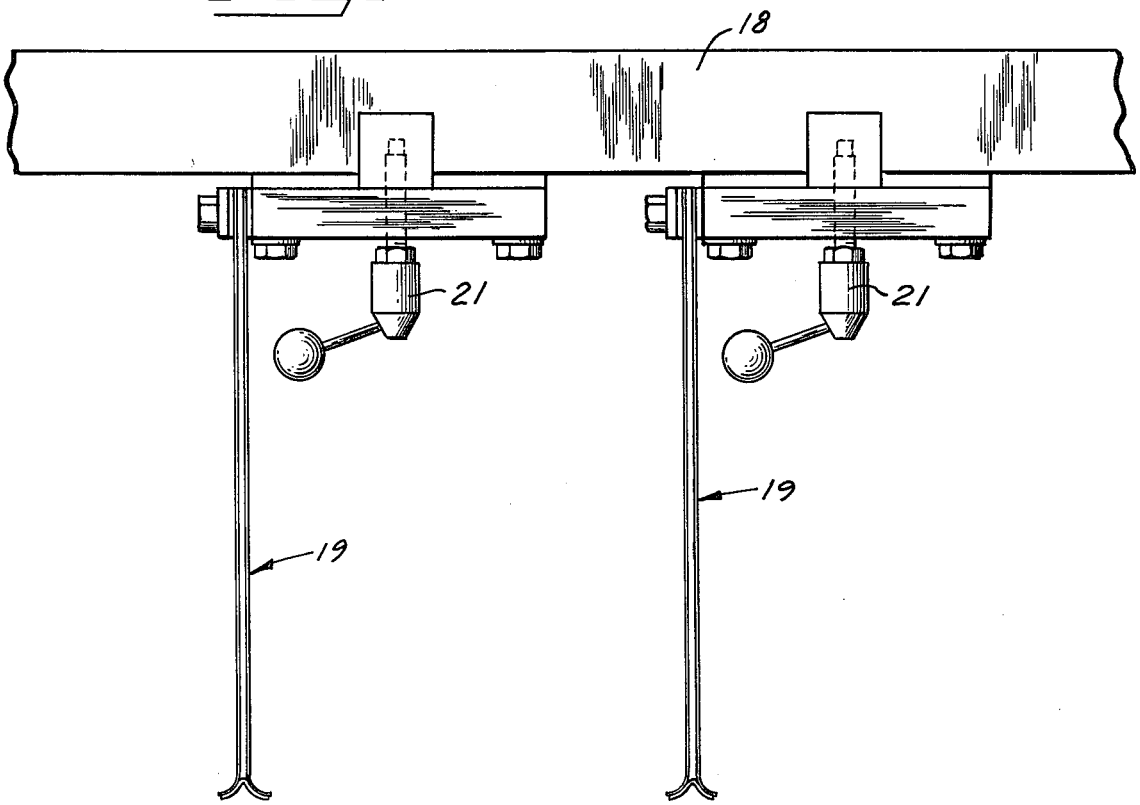
FIG. 3 is a front elevational view of a pair of divider assemblies.

In a more specific embodiment of the invention shown in FIGS. 2 and 3, there is illustrated a frame structure 17 to which there is rigidly secured an inverted channel member 18. The channel member carries a plurality of dividers 19 which will be more specifically described subsequently. The dividers are adjustable laterally by means of a pair of ways 20 which permit such relative lateral movement to accommodate different width sheets. The dividers 19 can be clamped in laterally adjustable predetermined position by means of clamps 21.

The dividers 19 are arranged to cooperate with a table or tray 22 which is pivoted on a shaft 23. The tray 22 carries a pusher element 24 which is arranged to provide a stop for the sheets as they are loaded onto the tray, and ultimately to discharge the stack of sheets onto a discharge conveyor, as noted in connection with FIG. 1.

The entire tray assembly 22 is movable from a substantially horizontal, discharge position shown in solid lines, to an inclined loading position shown in dotted outline in FIG. 2. Pivotal movement of the entire tray assembly 22 is accomplished by means of a chain 25 trained around a sprocket 26 and operating between a pair of limit switches 27 and 28. The tray 22 carries a gear box 29 and a drive motor 30.

Figure 4:
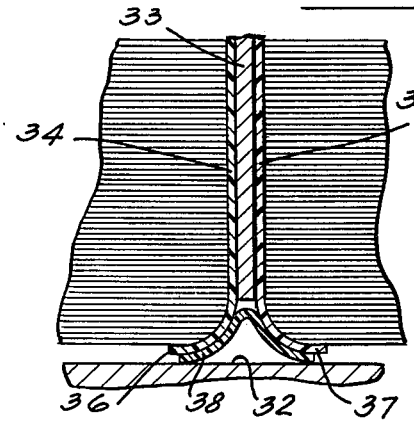
FIG. 4 is an enlarged fragmentary cross-sectional view of a divider assembly in position on the tray as the sheets are being received therealong.
Figure 6:
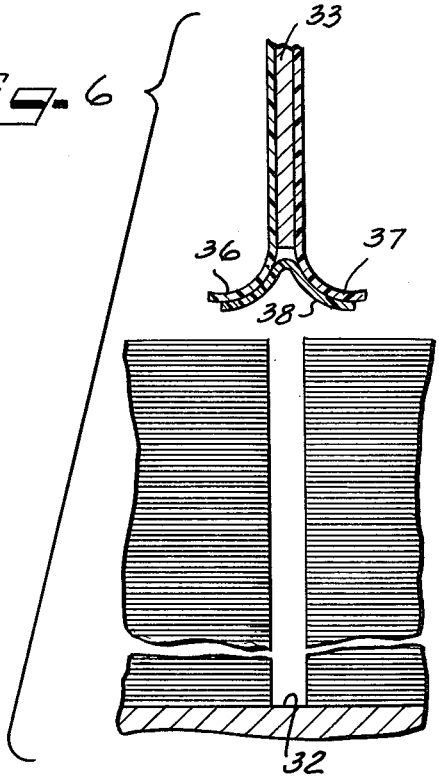
FIG. 6 is a view similar to FIG. 5 but showing the divider completely withdrawn.
Figure 5:
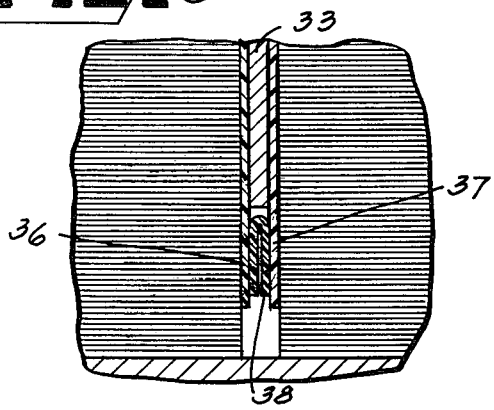
FIG. 5 is a view of the divider assembly after the stacking has been completed and while the divider is being withdrawn.

In the loading position shown in dotted outline in FIG. 2, a conveyor 31 delivers sheets onto the inclined upper surface 32 of the tray between a pair of suitably aligned dividers 19. The structure of the individual dividers 19 is best illustrated in FIGS. 4, 5 and 6. As seen in those figures, each divider 19 may include a relatively thin but substantially rigid core 33, the opposite faces of which are secured to a pair of flexible strips 34 and 35 such as by adhesives. Particularly suitable material in this regard consists of a polyethylene strip having adhesive on one face and measuring about 0.005 inch (0.127 millimeters) in thickness. The ends of the strips 34 and 35 extend below the lower end of the core 33 to provide flared foot portions 36 and 37, respectively. Interconnecting these flared portions is a hinge member 38 which is preferably adhesively secured to the inner surfaces of the foot portions, and terminates short of the lower end of the core 33. The hinge member 38 is also preferably composed of a thin polyethylene tape of about 0.005 inch (0.127 millimeters thickness). The hinge provides the required resilience for the foot members 36 and 37 to open each time the divider assembly is pressed against the surface 32.

When the stacking has been completed, the dividers and the trays undergo relative pivotal movement by the trays being pivoted downwardly into the discharge position. As this occurs, the sheets 36 and 37 as well as the hinge 38 are collapsed inwardly as shown in FIG. 5 in which condition they can be readily removed from between two adjoining stacks.

Upon complete removal as shown in FIG. 6, the foot portions 36 and 37 resume their outward flare, together with the hinge portion 38.

It has been found that the structure of the present invention has an extended useful life because it provides sufficient strength to open into its loading position and yet collapses easily enough to permit withdrawal from between the stacks. What is more, the use of synthetic resins such as polyethylene with its low coefficient of friction actually facilitates withdrawal of the divider from between the stacks.

While the drawings illustrate the divider of the present invention as being used with a specific type of loading mechanism, it should be evident that the divider will find applicability with various types of sheeter mechanisms.

It should be evident that various modifications can be made to the described embodiments without departing from the scope of the present invention.

We claim as our invention:

1. In a stacker mechanism including a tray, means for moving said tray from a sheet receiving position to a sheet discharging position, and pusher means for discharging sheets from said tray in its sheet discharging position, a divider positionable on said tray to separate sheets into separate adjacent stacks, said divider including a relatively thin central core and a pair of flexible feet secured to said core and having free ends extending below the lower edge of said core and laterally outwardly of said core, said feet being sufficiently flexible to be collapsed inwardly when said divider is withdrawn from between said adjacent stacks, thereby permitting easy withdrawal of said divider from between said stacks.

2. A stacker mechanism as claimed in claim 1 in which said divider includes flexible hinge means interconnecting said pair of flexible feet.

3. A stacker mechanism according to claim 2 in which said flexible feet and said hinge means are composed of thin strips of a flexible synthetic resin.

4. A stacker mechanism according to claim 3 in which said feet are adhesively secured to opposite sides of said divider and said hinge means is secured between the free ends of said feet.

5. A divider for dividing adjacent stacks of sheets comprising a relatively thin central core, a pair of flexible strips secured to opposite faces of said core and having free end portions extending therebeyond, and flexible hinge means interconnecting said free end portions and urging said free end portions outwardly from said core, said flexible strips and said hinge means being sufficiently thin to be inwardly collapsed below said core and exhibit a combined thickness not greater than said core when so collapsed.

6. The divider of claim 5 in which said flexible strips and said hinge means are all composed of a thin synthetic resin.

7. The divider of claim 6 in which said strips are adhesively secured to said faces and said hinge means is adhesively secured to said free end portions.

8. In a stacker mechanism the combination comprising, a tray having an upwardly facing surface for receiving at least two stacks of sheets in side-by-side relationship with the sheets being delivered to be stacked on the tray; a vertical divider relatively movable between a first position above the tray dividing the stacks and a second withdrawn position wherein it is lifted above the stacks, and flexible feet on the lower edge of the divider extending laterally of the divider and engaging the upper surface of the tray at the edges of the stacks in said first position and collapsible to the width of the divider as the divider is moved from between the stacks to said second position whereby the feet aid in alignment of the sheets during initial formation of the stacks and can be withdrawn with the divider without dislocating the stacks.

* * * * *